US006432227B1

(12) United States Patent
Hayakawa et al.

(10) Patent No.: US 6,432,227 B1
(45) Date of Patent: Aug. 13, 2002

(54) ELECTROMAGNETIC STEEL SHEET AND PROCESS FOR PRODUCING THE SAME

(75) Inventors: Yasuyuki Hayakawa; Mitsumasa Kurosawa; Michiro Komatsubara, all of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/970,327

(22) Filed: Oct. 3, 2001

Related U.S. Application Data

(62) Division of application No. 09/427,224, filed on Oct. 26, 1999, now Pat. No. 6,322,635.

(30) Foreign Application Priority Data

Oct. 27, 1998 (JP) ..... 10-305128
Nov. 27, 1998 (JP) ..... 10-336996

(51) Int. Cl.[7] ..... H01F 1/04
(52) U.S. Cl. ..... 148/308; 420/117
(58) Field of Search ..... 148/307, 308; 420/117

(56) References Cited

U.S. PATENT DOCUMENTS

| | | | | |
|---|---|---|---|---|
| 5,853,499 A | | 12/1998 | Komatsubara et al. | |
| 6,039,818 A | * | 3/2000 | Toge et al. | 148/307 |
| 6,139,650 A | * | 10/2000 | Oda et al. | 148/306 |
| 6,159,309 A | * | 12/2000 | Kurosaki et al. | 138/308 |

FOREIGN PATENT DOCUMENTS

| | | |
|---|---|---|
| EP | 0 339 475 A2 | 11/1989 |
| EP | 0 716 151 A1 | 6/1996 |
| EP | 0 837 149 A2 | 4/1998 |
| EP | 0 869 190 A1 | 10/1998 |
| JP | 05051705 | 3/1993 |
| JP | 05345921 | 12/1993 |
| JP | 06017201 | 1/1994 |
| JP | 07076732 | 3/1995 |

* cited by examiner

*Primary Examiner*—John Sheehan
(74) *Attorney, Agent, or Firm*—Schnader Harrison Segal & Lewis LLP

(57) ABSTRACT

Electromagnetic steel sheet from a high-purity steel slab, composed essentially of Si 2.0 to 8.0 wt %, Mn 0.005 to 3.0 wt % and Al 0.0010 to 0.012 wt % with each of Se, S, N and O each not more than 30 ppm.

4 Claims, 8 Drawing Sheets

ELECTROMAGNETIC STEEL SHEET AND PROCESS FOR PRODUCING THE SAME

This application is a divisional of application Ser. No. 09/427,224, filed Oct. 26, 1999 now U.S. Pat. No. 6,322,635, incorporated herein by reference.

BACKGROUND OF THE INVENTION

1. Field of the Invention

This invention is particularly directed to electromagnetic steel sheets which are suitable as materials for iron cores used in transformers or motors. It is particularly directed to electromagnetic steel sheets which have superior formability and magnetic properties, and to their production.

As measures to resolve increasing environmental problems such as the greenhouse effect caused by carbon dioxide emissions, the demand for electric cars is rising today. With the progress of cellular phones and Internet systems, electromagnetic shields have also been called for in the medical sector and the like. Specifically, as a material used for iron cores in small-scale electrical facilities and for electromagnetic shields, the demand for an intermediate grade of electromagnetic steel sheet is growing. An intermediate grade of electromagnetic steel sheet is one that has magnetic properties and production costs that are grouped between a grain-oriented electromagnetic steel sheet and a non-oriented electromagnetic steel sheet.

2. Description of the Related Art

A steel sheet used as a material for iron cores in transformers or motors is named an "electromagnetic steel sheet" after its applications. To this end, a grain-oriented electromagnetic steel sheet and a non-oriented electromagnetic steel sheet have been widely used.

The grain-oriented electromagnetic steel sheet is a silicon-containing steel sheet in which the grains of the sheet have been oriented in an orientation of (110) [001] or (100) [001] in the rolling direction. In the grain-oriented electromagnetic steel sheet, the grain orientation noted is generally attained by making use of a phenomenon termed "secondary recrystallization" during final finishing annealing. The technique of secondary recrystallization has heretofore been required to be performed by incorporating so-called inhibitor components in the steel material, by heating the resulting steel slab at a high temperature so as to bring the inhibitors into the form of solid solutes at high temperature, and subsequently by hot-rolling the steel slab to precipitate the inhibitors in a fine form.

For examples of inhibitors, Japanese Examined Patent Publication No. 40-15644 discloses using AlN and MnS, and Japanese Examined Patent Publication No. 51-13469 discloses using MnS and MnSe. These methods have now been implemented on an industrial basis. Use of CuSe and BN is disclosed in Japanese Examined Patent Publication No. 58-42244, and use of nitrides of Ti, Zr and V is disclosed in Japanese Examined Patent Publication No. 46-40855.

The above-mentioned inhibitor-related methods are capable of stably developing secondarily recrystallized grains. In these methods, however, the steel slab needs to be heated at a high temperature exceeding 1,300° C., prior to hot rolling, to disperse precipitates in fine form. Such high-temperature slab heating places a heavy burden of cost on equipment, and moreover, causes a great deal of scale that occurs during hot rolling, eventually bringing about a low level of yield as well as a tedious task of equipment maintenance.

In producing a grain oriented electromagnetic steel sheet by use of inhibitors, final finishing annealing is usually carried out by means of batch annealing at a high temperature and for a long period of time. When left unremoved after completion of the final finishing annealing, inhibitor components tend to deteriorate the desired magnetic properties of the steel. To remove inhibitor components such as, for example, Al, N, Se and S from the steel, purifying annealing has to be effected, subsequent to secondary recrystallization, in a hydrogen atmosphere at 1,100° C. or higher and over several hours. The high-temperature purifying annealing, however, makes the steel sheet product mechanically weak so that the resulting coil tends to buckle at its lower portion. Further, this effect is responsible for a sharp decline in yield.

To alleviate the foregoing shortcomings of batch annealing and to simplify the process steps, attempts have hitherto been made to convert batch annealing to continuous annealing. Methods intended for producing a grain oriented electromagnetic steel sheet by continuous annealing are disclosed in Japanese Examined Patent Publication Nos. 48-3929 and 62-31050, Japanese Unexamined Patent Publication No. 5-70833. Both of the conventional methods are designed to perform secondary recrystallization by the use of inhibitors such as AlN, MnS, MnSe and the like and within a short period of time. In practice, continuous annealing over a short period of time fails to remove inhibitor components, tending to leave the same in the steel sheet product. The inhibitor components, particularly Se and S that have remained in the steel, may obstruct the movement of magnetic domain walls, ultimately producing adverse effects on iron loss properties. Still another problem is that the inhibitor components are brittle elements which are therefore likely to render the steel sheet product less easy to fabricate. Thus, the magnetic properties and formability are not made feasible as desired, so long as inhibitors are used to achieve secondary recrystallization.

In Japanese Unexamined Patent Publications Nos. 64-55339, 2-57635, 7-76732 and 7-197126, there are disclosed methods which contemplate producing, without reliance on inhibitors, electromagnetic steel sheets having small grain diameters. The methods cited here are common to the fact that tertiary recrystallization is utilized in which priority is given to the growth of grains having a {110} plane by the use of surface energy as a driving force.

To ensure that the difference in surface energy will be effectively utilized is deemed to be the crux of each of those methods; however, the sheet thickness is required to be small so that the sheet surface is greatly receptive to and affected by surface energy. For example, Japanese Unexamined Patent Publication No. 64-55339 discloses a sheet thickness that is not more than 0.2 mm, and Japanese Unexamined Patent Publication No. 2-57653 discloses a sheet thickness of not more than 0.15 mm. In Japanese Unexamined Patent Publication No. 7-76732, no restriction is imposed on the sheet thickness, but Example 1 of this publication reveals that a sheet thickness of 0.3 mm renders the steel sheet less affected by surface energy, consequently deteriorating the integrity of grain orientation and reducing the magnetic flux density to an extreme extent, i.e., not more than 1.70 T in terms of the $B_8$ value. Among the examples of the publication now discussed, the sheet thickness is limited to 0.10 mm so as to obtain good magnetic flux density. Also in Japanese Unexamined Patent Publication No. 7-197126, the sheet thickness is not restricted. However, since this publication is directed to a technique in which tertiary cold rolling is effected in a ratio of 50 to 75%, the sheet thickness is necessarily small, and in fact, is 0.10 mm as shown in the examples.

According to the known methods in which surface energy is utilized, the thickness of a steel sheet product has to be always small to attain good magnetic properties. Thus, a serious problem is that such a thin steel sheet product is not capable of overcoming poor punching capabilities; that is, the steel sheet product is difficult to use as a material for ordinary iron cores.

Meanwhile, the non-oriented electromagnetic steel sheet is a silicon-containing steel sheet in which the diameter and orientation of primarily recrystallized grains have been controlled by means of continuous annealing. This steel sheet is characterized by good electromagnetic properties irrespective of which direction has been subjected to rolling, but it has by far lower magnetic properties in the rolling direction than grain oriented electromagnetic steel sheets in common use.

SUMMARY OF THE INVENTION

One object of the present invention is to provide an electromagnetic steel sheet which is useful as a material for iron cores particularly in small-scale electrical components and for electromagnetic shields, and is adequately formable and highly capable of exhibiting superior magnetic properties.

Another object of this invention is to provide a process for the production of such an electromagnetic steel sheet by means of continuous annealing and without reliance on inhibitors and surface energy.

The present inventors have conducted researches on the formation of a recrystallized structure using an inhibitor-free high-purity starting steel material.

Through the researches leading to the present invention, the inventors have found that a structure having a {110}<001> orientation can be developed at a high level after recrystallization when a high-purity starting steel material is prepared, under certain specific conditions, by decreasing the contents in the steel particularly of Se, S, N and O.

This invention further provides a process for the production of an electromagnetic steel sheet having superior formability and magnetic properties, wherein the steel slab comprises iron with Si in a content of about 2.0 to 8.0 wt %, Mn in a content of about 0.005 to 3.0 wt %, and Al in a content of about 0.0010 to 0.012 wt % with each of Se, S, N and O in a small amount, at a content of not more than about 30 ppm each, which process comprises: hot-rolling a steel slab to form a hot-rolled steel sheet; optionally annealing the hot-rolled steel sheet; cold-rolling the annealed steel sheet once or any plurality of times, each of the instances of plural cold rolling including intermediate annealing, thereby finishing the cold-rolled steel sheet to a final thickness; recrystallization-annealing the cold-rolled steel sheet; and optionally applying an insulation coating to the annealed steel sheet, and wherein the recrystallization annealing is continuous annealing.

Preferably, the average grain diameter before final cold rolling is controlled to about 0.03 to 0.2 mm, the final cold rolling is carried out at a reduction ratio of about 55 to 75%, and the recrystallization annealing is performed at a temperature of about 950 to 1,175° C. Preferably, the hot-rolled sheet annealing and the intermediate annealing are performed at a temperature of about 800 to 1,050° C., respectively. Preferably, the total content of Se, S, N and O in the steel slab is controlled to be not more than about 65 ppm. Preferably, the steel slab further includes Ni in a content of about 0.01 to 1.50 wt %. Preferably, the steel slab further includes at least one element selected from the group consisting of Sn in a content of about 0.01 to 0.50 wt %, Sb in a content of about 0.005 to 0.50 wt %, Cu in a content of about 0.01 to 0.50 wt %, Mo in a content of about 0.005 to 0.50 wt %, and Cr in a content of about 0.01 to 0.50 wt %. The steel slab can be subjected to hot rolling with preheating omitted. A thin cast steel sheet derived from direct casting of molten steel and having a thickness of not more than about 100 mm can be subjected to hot rolling as a starting steel material, or the cast steel sheet can be used as it is in place of a hot-rolled steel sheet.

The electromagnetic steel sheet of this invention has superior formability and magnetic properties, which results from recrystallization annealing of a steel slab by means of continuous annealing, and comprises Si in a content of about 2.0 to 8.0 wt %, a thickness of more than about 0.15 mm, an average grain diameter of about 0.15 to 5 2.0 mm and a magnetic flux density of about $B_8$>1.70 T in the rolling direction.

Preferably, the electromagnetic steel sheet further includes Mn in a content of about 0.005 to 3.0 wt % and Al in a content of about 0.0010 to 0.012 wt %, with each of Se, S, N and O reduced to a content of not more than about 30 ppm. Preferably the total content of Se, S, N and O is not more than about 65 ppm, and the magnetic flux density is $B_8$>about 1.75 T in the rolling direction. Preferably, the steel sheet further includes Ni in a content of about 0.01 to 1.50 wt %. Preferably, the steel slab further includes at least one element selected from the group consisting of Sn in a content of about 0.01 to 0.50 wt %, Sb in a content of about 0.005 to 0.50 wt %, Cu in a content of about 0.01 to 0.50 wt %, Mo in a content of about 0.005 to 0.50 wt % and Cr in a content of about 0.01 to 0.50 wt %.

DESCRIPTION OF THE PREFERRED EMBODIMENTS

Various experimental results will now be described.

Experiment 1

Many different composite steel slabs were formulated and melted for testing. In these instances, slab formulations included C: 33 ppm, Mn: 0.15 wt %., Si: 3.3 wt % and Al: 0.0050 wt %. These were held constant as basic components, while impurities such as Se, S, N and O were added in varied amounts. Other impurities other than the latter four were set not to exceed 30 ppm. After being heated at 1,100° C., each slab was hot-rolled to a 2.2 mm-thick hot-rolled steel sheet. The resulting steel sheet was cold rolled to an intermediate thickness of 0.85 mm and brought to a final thickness of 0.35 mm by means of second cold rolling subsequently to intermediate annealing at 900° C. for 60 seconds. Recrystallization annealing was thereafter effected at 1,000° C. for 3 minutes.

Figure 1:
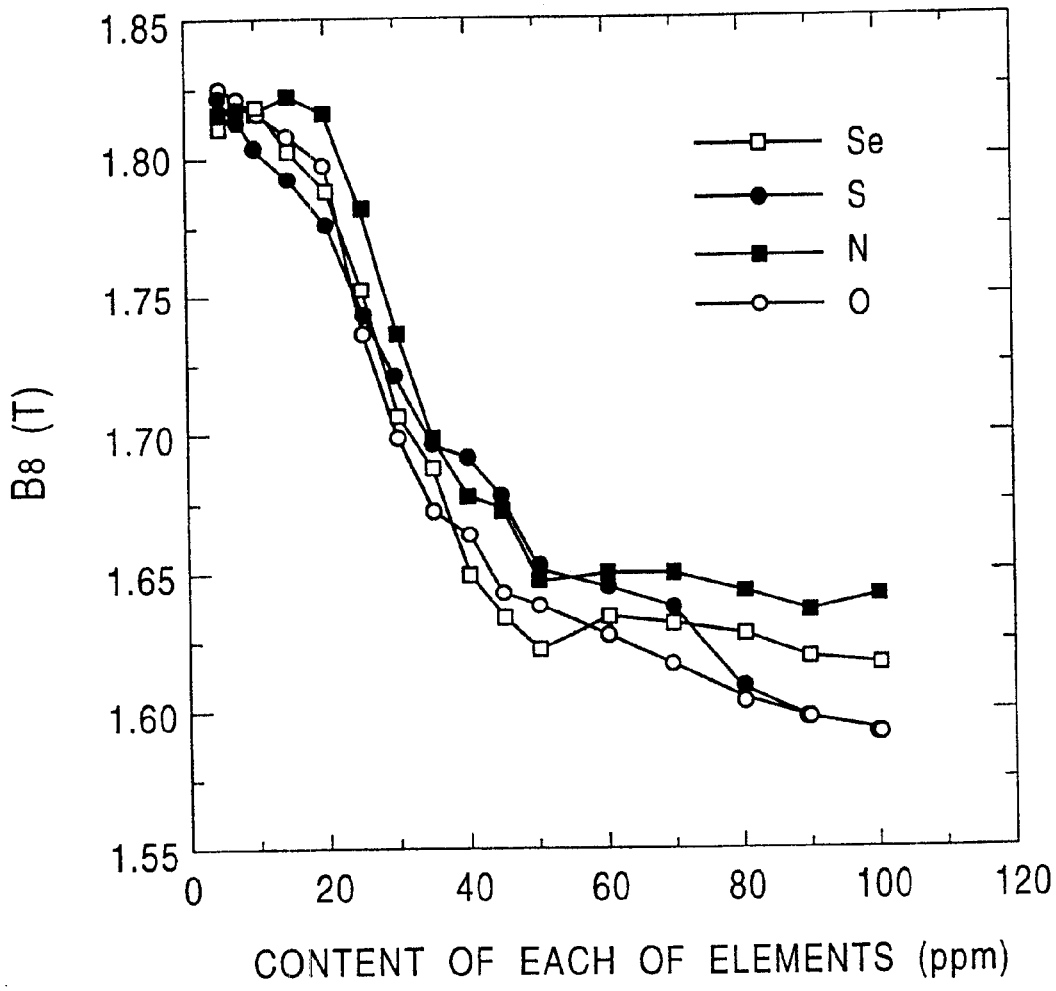
FIG. 1 graphically represents the effects of elements that we have found to be impurity elements (Se, S, N and O) in the starting steel material upon the magnetic flux density $B_8$ in the rolling direction of an electromagnetic steel sheet of the present invention.

The recrystallized grain diameter, after annealing, was approximately 0.25 mm on the average in each steel sheet. Examination was made of the relationship between the content of each impurity in the steel and the magnetic flux density $B_8$ of the steel sheet product in the rolling direction. The results thus obtained are shown in FIG. 1, from which the magnetic flux density was found to be more than 1.70 T when the content of each of Se, S, N and O was not more than 30 ppm.

Experiment 2

Next, the effects of impurities and their total content were examined. An experiment was carried out substantially under the same conditions as in Experiment 1. Slabs were used which had been prepared such that the total content of impurities other than the content-varying ones (Se, S, N and O) noted in the previous experiment was controlled not to exceed 35 ppm.

Figure 2:
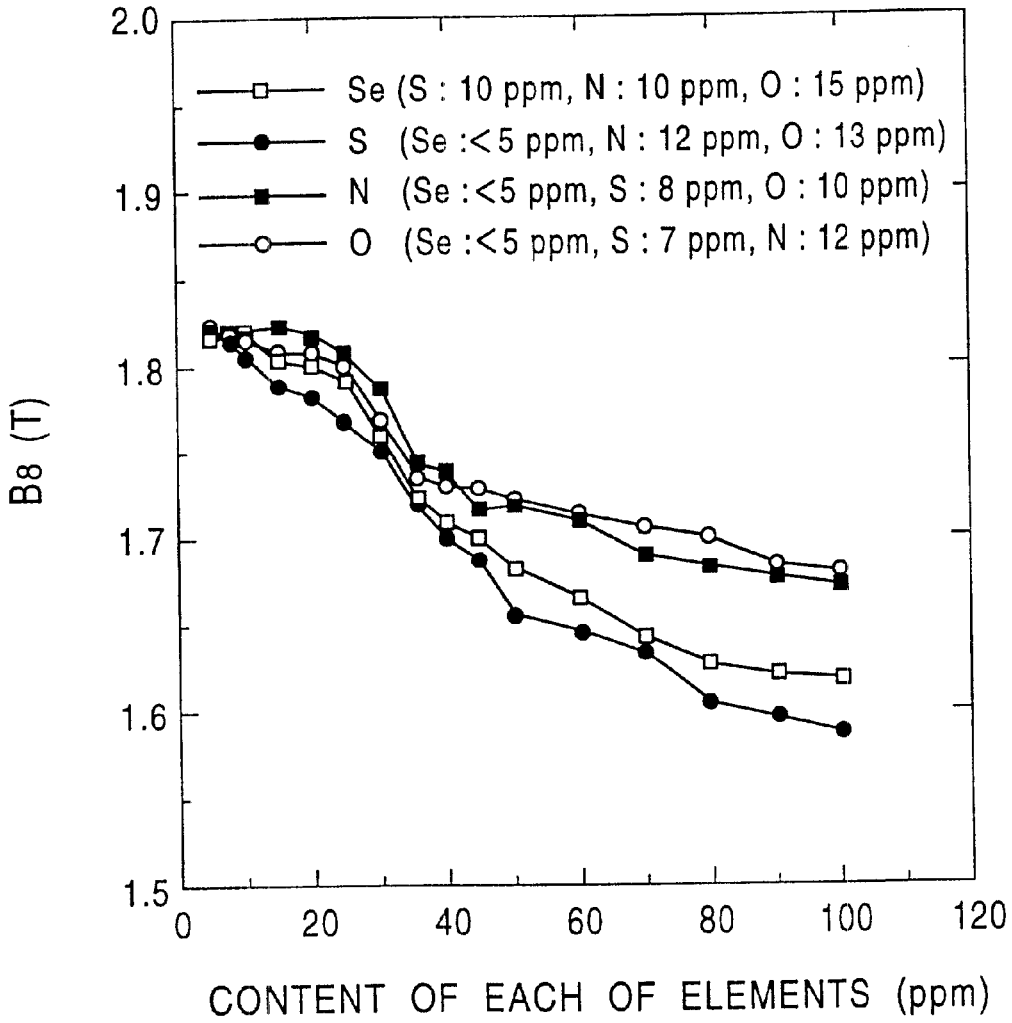
FIG. 2 graphically represents the effects of impurity elements Se, S, N and O, with their total content having been controlled, in a starting steel material upon the magnetic flux density $B_8$ in the rolling direction of the steel sheet product.

Each of the resultant steel sheets was measured for magnetic flux density in the rolling direction after recrystallization annealing. The results thus obtained are shown in FIG. 2. The magnetic flux density was found to be more than 1.75 T when the content of each of Se, S, N and O was not more than 30 ppm. The recrystallized grain diameter after intermediate annealing was about 0.10 mm, on the average, in each steel sheet.

Figure 3:
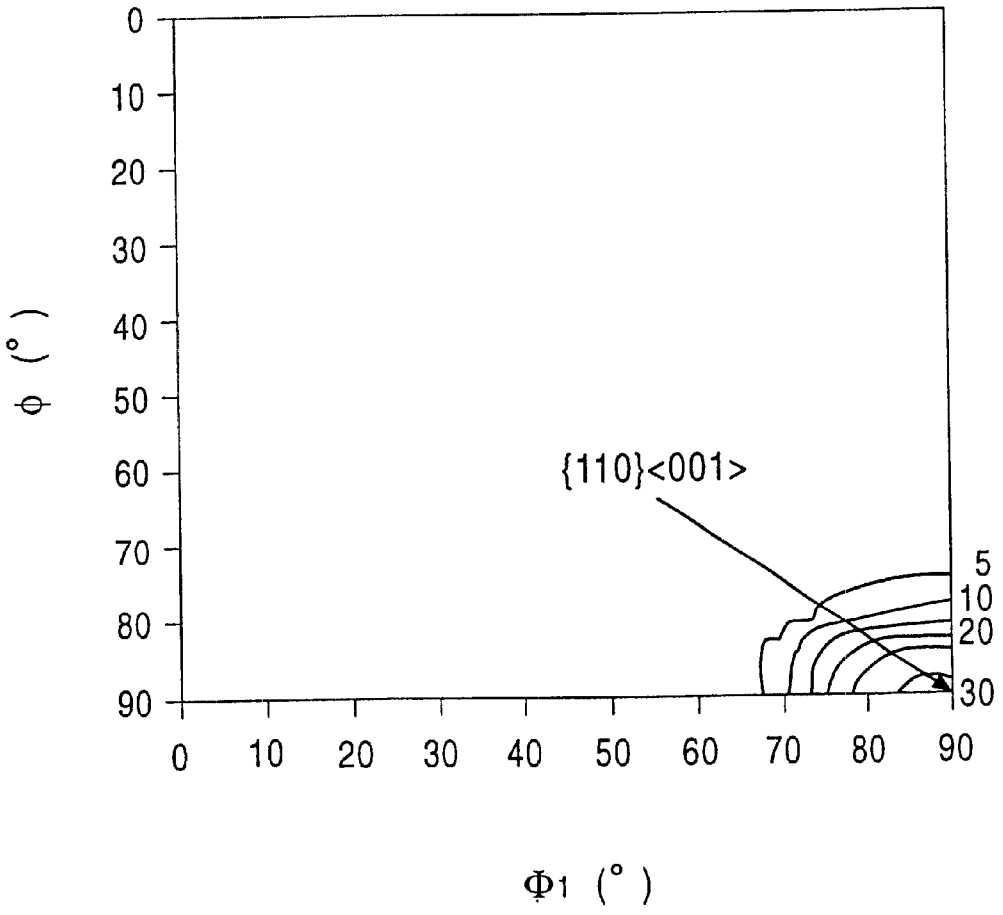
FIG. 3 is a graph showing the integral structure of the steel sheet product after recrystallization annealing.

Additionally, X-ray inspection was made for the grain structure of a steel sheet product having a magnetic flux density $B_8$ of 1.81 T in a rolling direction. The results thus obtained are shown in FIG. 3, from which the structure was found to become integral at a high level in an orientation of {110}<001> with consequent absence of components in other orientations.

From the results of Experiments 1 and 2, it has been found that in the case of use of the foregoing high-purity starting steel materials, the resulting structures can develop in an orientation of {110}<001> even by means of shortened recrystallization annealing, exhibiting improved magnetization properties in the rolling direction.

Experiment 3

The present inventors have conducted further researches on elements constituting starting steel materials, finding that Ni contributes to improved magnetic flux density of such a steel sheet product.

Different composite steel slabs (Se: 5 ppm or less, S: 10 ppm, N: 9 ppm and O: 11 ppm) were melted which had been formulated with, as basic components, C: 22 wt ppm, Mn: 0.12 wt %, Si: 3.3 wt %, Al: 0.0040 wt % and Ni in varied contents. After being heated at 1,140° C., each such steel slab was hot-rolled to a 2.5 mm-thick hot-rolled steel sheet which was then cold-rolled to a thickness of 0.80 mm, followed by intermediate annealing at 800° C. for 120 seconds. Thereafter, the steel sheet was finished to a thickness of 0.26 mm by means of cold rolling and then recrystallization-annealed at 1,050° C. for 5 minutes. The average grain diameter prior to final cold rolling was in the range of 0.085 to 0.095 mm.

Figure 4:
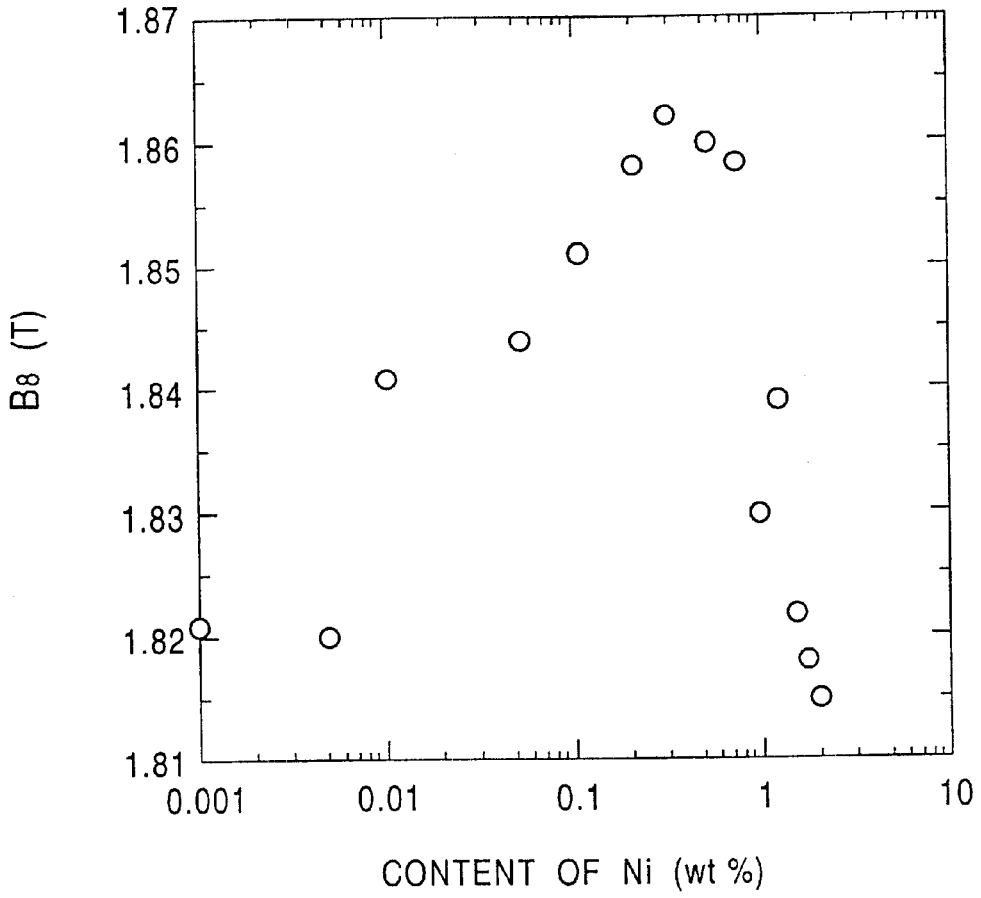
FIG. 4 graphically represents the effects of the content of Ni in the steel sheet product upon the magnetic flux density.

The resulting steel sheet was measured for magnetic flux density in the rolling direction. The results are shown in FIG. 4. Addition of Ni in controlled amounts, as shown, was conducive to improvements in magnetic flux density.

Here, the reason the magnetic flux density is improved is not clearly known. Because of its strong magnetic nature, Ni would presumably participate in any form in improving the magnetic flux density.

In addition, at least one of Sn, Sb, Cu, Mo and Cr when added was found to improve iron loss. This may be due to the fact that increased electrical resistance results in reduced Iron loss.

Experiment 4

We have conducted further researches on the effects of steel grain diameter before final cold rolling, and of the reduction ratio during final cold rolling, upon the magnetic properties of a steel sheet product.

Figure 5:
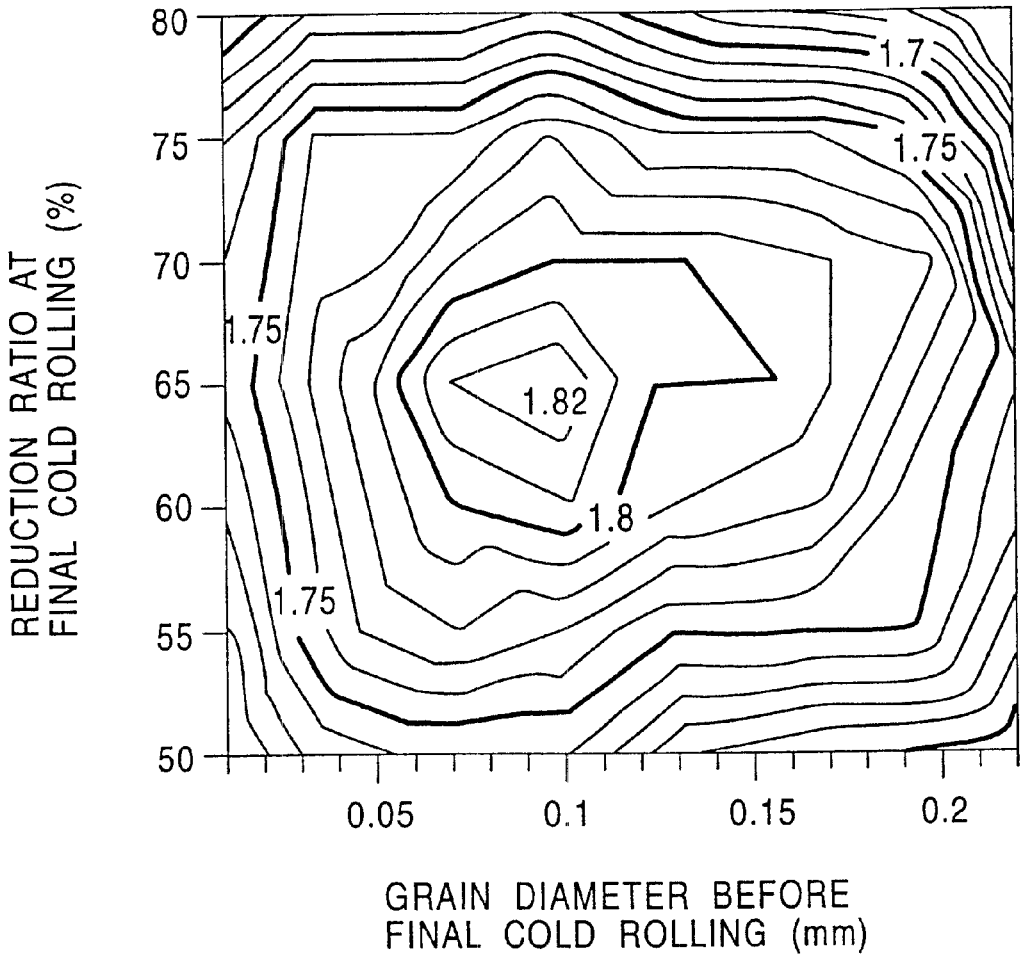
FIG. 5 is a graph showing the effects of reduction ratio at the step of cold rolling and the average grain diameter of the steel sheet product before final cold rolling upon the magnetic flux density.

The same steel slab (Se: 5 ppm or less, S: 13 ppm, N: 12 ppm and O: 15 ppm) as in Experiment 3 was used in which the grain diameter before final cold rolling had been varied by changing the intermediate sheet thickness and the intermediate annealing temperature. The resulting steel sheet was finished to a thickness of 0.29 mm, followed by recrystallization annealing at 1,100° C. for 5 minutes. The steel sheet product was measured for magnetic flux density with the results shown in FIG. 5. Desired magnetic flux densities of $B_8$>1.75 T were attainable in a grain diameter of 0.03 to 0.20 mm before final cold rolling and in a reduction ratio of 55 to 75% during final cold rolling.

In conclusion, it was found, as shown, that the magnetic flux density of the steel sheet product was greatly affected by the grain diameter before final cold rolling and by the reduction ratio during final cold rolling.

Experiment 5

We have conducted further researches on the effects of the average grain diameter in the steel sheet product upon its formability.

The same process steps as in Experiment 1 were repeated up to cold rolling, whereby a steel sheet product was finished with a thickness of 0.23 mm. The grain diameter of the steel sheet product was varied by changing the recrystallization annealing conditions after cold rolling. Inspection was made of the formability of the steel sheet product. Formability was measured by punching the steel sheet product at 100 points with a 5 mm-diameter punch and by observing the frequency of cracking and wrinkling around the punched holes. The results thus obtained are shown in FIG. 6.

Figure 6:
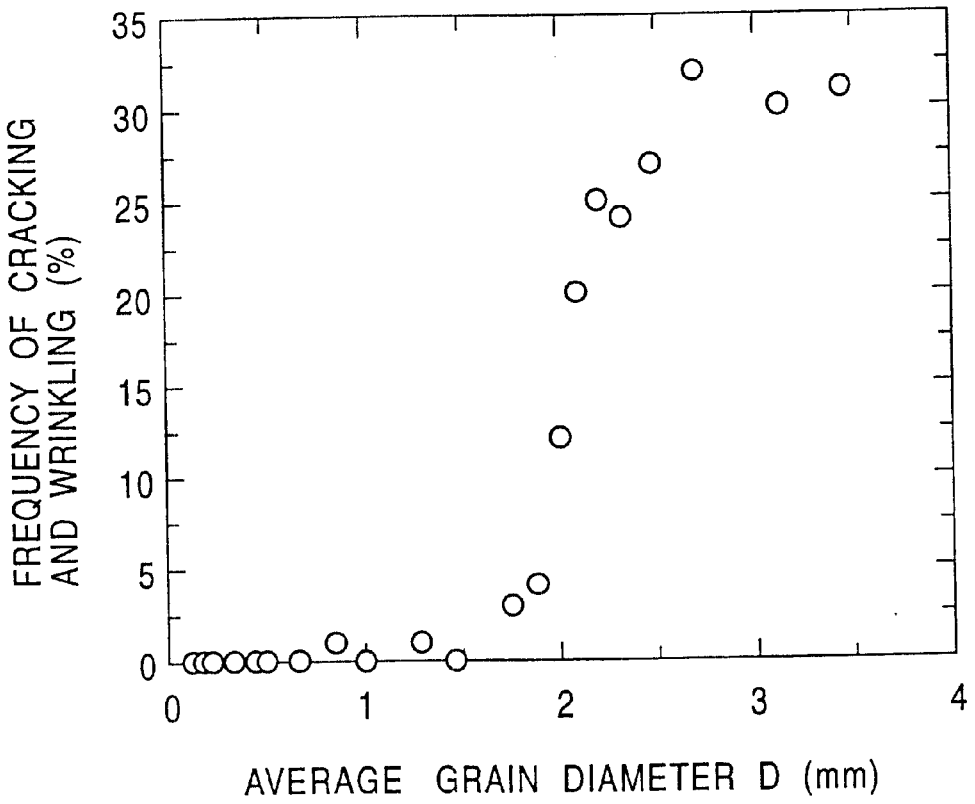
FIG. 6 graphically represents the effects of the average grain diameter in the steel sheet product upon the sheet formability.

As evidenced by FIG. 6, cracking and wrinkling were found to occur less frequently in an average grain diameter range of about 2 mm or less.

In practical application, an electromagnetic steel sheet sometimes needs stress relief annealing to remove strain which would occur during forming of the steel sheet, and to recover its magnetic properties. Even in the case of applications in which emphasis is placed on formability, therefore, care should be taken to prevent the magnetic properties from becoming irregular after such steel sheet is stress relief annealed.

For that reason, specimens prepared in this experiment and having different grain diameters were subjected to shearing, followed by annealing at 800° C. for 2 hours and by subsequent inspection of variance of iron loss. The results thus obtained are shown in FIG. 7, in which the effects of the average grain diameter in the steel sheet product, upon the variance in iron loss, are viewed.

Figure 7:
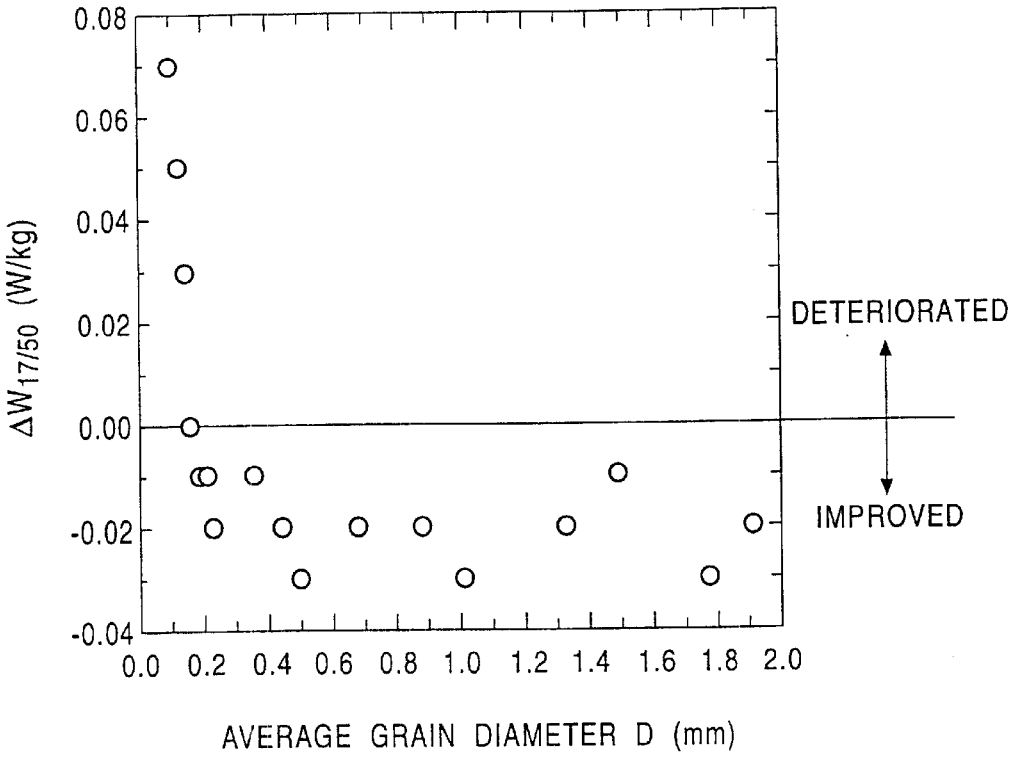
FIG. 7 graphically represents the effects of the average grain diameter in the steel sheet product upon the variance of iron loss before and after the performance of stress relief annealing.

As is clear from FIG. 7, shear strain was removed after annealing so that iron loss was improved when the grain diameter was large. However, grain diameters of less than 0.15 mm caused a sharp deterioration in iron loss and also made the magnetic flux density lower than that before annealing.

Inspection was made of the grain structure which had suffered from deteriorated iron loss. It was found that the grains grew from sheared portions of the steel sheet product and became coarse.

The cause is believed to be that in the case of small grain diameters, grains less likely to orient may coarsely grow from the sheared portions due to residual driving force for grain growth.

It has been found, therefore, that failure to observe grain diameters of more than 0.15 mm results in unacceptable magnetic properties after stress relief annealing.

The electromagnetic steel sheet provided in accordance with the present invention is in the range of about 0.15 to 2.0 mm in average grain diameter which is fine as compared to grain diameters of about 3 to 30 mm in a conventional grain-oriented electromagnetic steel sheet produced by use of inhibitors and by means of secondary recrystallization. These small grain diameters of this invention are remarkably advantageous in enhancing the formability of the steel sheet product, by operations such as punching or drilling. The present invention is specifically designed to develop an {110}<001> oriented structure by means of continuous annealing so that the electromagnetic steel sheet can be provided with greater formability than any formability obtained by conventional techniques based upon use of inhibitors and use of secondary recrystallization.

The process of the present invention has created an electromagnetic steel sheet which is derivable from continuous annealing of a starting steel material, and is of an orientation structure of {110}<001> developed at a high level, producing steel having small grain diameter and having superior in formability.

Furthermore, the present invention can develop a {110}<001> oriented structure by means of continuous annealing in a short time period, thus producing an electromagnetic steel sheet having a forsterite coating-free clean surface as compared to a conventional grain-oriented electromagnetic steel sheet. Thus, the steel sheet of this invention is surprisingly advantageous because it is easy to punch with the use of dies.

Based on the aforementioned results, the electromagnetic steel sheet of the present invention has superior formability and magnetic properties, a {110}<001> oriented structure developed at a high level and a fine grain structure with an average grain diameter of about 0.15 to 2.0 mm, and moreover, provides a magnetic flux density of $B_8$>about 1.70 T.

According to the present invention, a {110}<001> structure developed at a high level after recrystallization can be obtained by subjecting an inhibitor-free high-purity starting steel material to critically controlled production conditions. The reason behind this is described below, as contrasted to the conventional inhibitor-relied technique.

We have discovered a priority phenomenon that occurs when a {110}<001> structure develops during recrystallization, finding that the {110}<001> structure does not fully develop at the time when recrystallization is completed, but grows with priority in the course of grain growth after recrystallization.

This priority of growth of grains having {110}<001> orientation is thought to be similar to the grain growth attained in the presence of inhibitors and by the use of secondary recrystallization.

Figure 8:
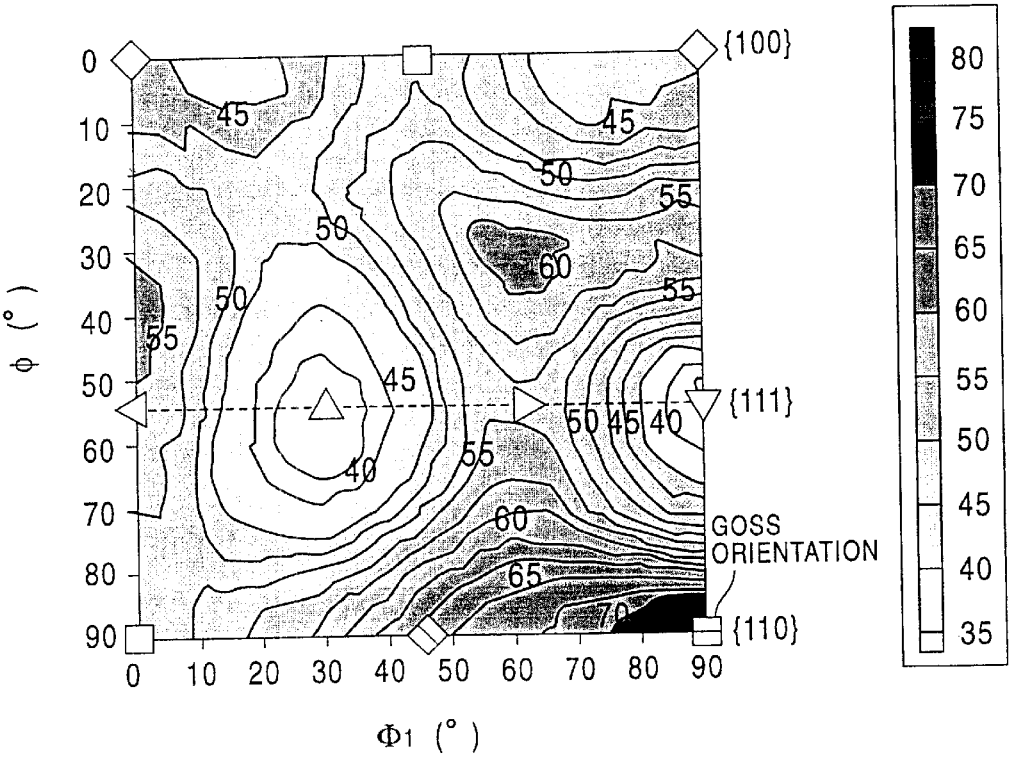
FIG. 8 schematically shows the frequency of occurrence (%) of each oriented grain in a grain boundary having an orientation angle difference of 25 to 45° in a primarily recrystallized structure of a grain oriented electromagnetic steel sheet.

We have conducted further researches on why a grain having a {110}<001> orientation recrystallizes in the presence of inhibitors, finding that a specific grain boundary has an important role when the grain boundary has an orientation angle difference of about 20 to 45°. This finding is disclosed in "Acta Material", p. 85, vol. 45 (1997). Analysis was made of a primarily recrystallized structure of a grain oriented electromagnetic steel sheet which was deemed to be equivalent to a structure of the steel sheet immediately before being secondarily recrystallized, and the ratio (%) of a grain boundary of 20 to 45° in orientation angle difference was checked with regard to the whole grain boundaries. The results thus obtained are shown in FIG. 8 in which grain orientation spaces are represented by a cross section of $\Phi_2$=45° of Euler's angles ($\Phi_1$, $\Phi$ and $\Phi_2$), and main orientations such as the Goss orientation are schematically represented. As viewed in FIG. 8, the frequency of occurrence was found to be highest (about 80%) in the grain boundary having an orientation angle difference of 20 to 45°.

According to the experimental results of C. G. Dunn et al. ("AIME Transaction", p. 368, vol. 188 (1949)), the grain boundary of 20 to 45° in orientation angle difference is in the nature of a high energy boundary. Since this high-energy grain boundary has a large inner free space and a random structure, atoms can easily move in that grain boundary. To be more specific, the diffusion of grain boundaries, in which atoms move through the grain boundaries, proceeds faster than such diffusion occurs in a grain boundary of high energy.

It is known that secondary recrystallization develops as so-called inhibitor precipitates grow at a diffusion-determining rate. The precipitates in a high-energy grain boundary preferentially grow coarse during finishing annealing. On the other hand, the force required for the grain boundaries to be prevented from movement, the so-called "pinning force," is inversely proportional to the particle diameters of the precipitates. Therefore, the high-energy grain boundary preferentially commences moving, thereby growing a {110}<001> oriented grain.

In carrying out secondary recrystallization by the use of inhibitors, it is required that Al, B, Se and S as well as N, Mn and Cu, that are intended to be chemically bonded to the former elements, should be added in suitable amounts and that the inhibitors should be dispersed in fine form. To this end, great care must be given to production conditions, particularly to the hot rolling step. As is well known, failure to satisfy these production conditions makes secondary recrystallization ineffective so that a {110}<001> structure does not develop though grain growth occurs normally.

Al, Se and the like that may be present in a steel material are likely to segregate in grain boundaries, especially in a random-structure high-energy grain boundary. When all of Al, Si and S as well as N, Mn and Cu intended to be bonded and the former elements are not added in suitable amounts, or when,precipitates are not dispersed in fine form, the manner in which Se, S and N segregate exerts a greater influence than does the mechanism in which orientation selectively depends on precipitates. Thus, it is thought that little difference is seen in the rate of movement between a high-energy grain boundary and other grain boundaries.

If the influences of impurity elements, particularly of Se, S, N and O, are precluded by the use of a high-purity starting steel material, a difference of movement rates can be ensured, which is inherently determined by the structure of a high-energy grain boundary. The rates of movement in grain boundaries are also increased with use of such a high-purity steel material. Even in an inhibitor-free high-purity system, therefore, a {110}<001> grain is presumed to preferentially grow in the course of grain growth after recrystallization.

According to the present invention, addition of Al in suitable amounts further allows a grain of a {110}<001> to properly grow during grain growth after recrystallization, producing improved magnetic properties. It should be noted that since N is added in as low an amount as possible, the present invention is essentially technically distinct from any conventional technique in which AlN is used as an inhibitor and secondary recrystallization is utilized.

The reason Al is conducive to improved magnetic properties is not clear. Al in a trace amount is presumed to effectively act to fix oxygen left unremoved in a trace amount in the steel material, thereby cleaning the matrix, or to form a dense oxide layer on the surface of the resulting steel sheet, thereby preventing nitridation during recrystallization annealing.

The process of the present invention contemplates using continuous annealing in producing an electromagnetic steel sheet. Such process is largely different in the technical concept from the conventional methods for the production of a grain-oriented electromagnetic steel sheet by the use of continuous annealing.

More specifically, in the conventional methods of producing a grain-oriented electromagnetic steel sheet by means of continuous annealing, secondary recrystallization is effected within a short period of time by use of inhibitors such as AlN, MnS, MnSe and the like as disclosed in Japanese Examined Patent Publications Nos. 48-3929 and 62-31050 and Japanese Unexamined Patent Publication No. 5-70833.

However, the inhibitor components cannot be removed by shortened annealing and are left as they are in the steel sheet product. Se and S among the inhibitor components obstruct magnetic domain walls from movement, adversely affecting iron loss. Further, since these elements are brittle in nature, the steel sheet product is less likely to fabricate well. Superior formability and magnetic properties, therefore, are not attained by continuous annealing when the inhibitors are used.

In contrast, the present invention uses inhibitor components but in a controlled low content. An electromagnetic steel sheet is provided with superior formability and magnetic properties even by means of continuous annealing.

Explanation is given as to the reasons the compositions of molten steel components and the production conditions are specified, as stated hereinbefore, in the practice of the process according to the present invention.

Si: about 2.0 to 8.0 wt %

Contents of Si of less than about 2.0 wt % cause γ transformation, making the hot-rolled structure greatly varied in nature. Additionally, superior magnetic properties are not obtainable because high-temperature sheeting is impossible during recrystallization annealing after final cold rolling. Conversely, contents of more than about 8 wt % are responsible for impaired fabrication of and also for reduced saturated magnetic flux density of the steel sheet product. Hence, the content of Si is in the range of about 2.0 to 8.0 wt %.

Mn: about 0.005 to 3.0 wt %

Mn is an element needed to obtain good hot rolling. Contents of Mn of less than 0.005 wt % are too low to produce significant results, whereas contents of more than 3.0 wt % make it difficult to perform cold rolling. Hence, the content of Mn is in the range of about 0.005 to 3.0 wt %.

Al: about 0.0010 to 0.012 wt %

Suitable amounts of Al lead to suitable development of {110}<001> oriented grains during grain growth after recrystallization. Contents of less than 0.0010 wt % cause reduced strength in an orientation of {110}<001>, eventually bringing reduced magnetic flux density. Contents of more than 0.012 wt % prevent grain growth during recrystallization, deteriorating iron loss. Hence, the content of Al is in the range of about 0.0010 to 0.012 wt %.

Se, 3, N and O: not more than about 30 ppm

Each of Se, S, N and O not only obstructs priority growth of grains having a {110}<001> orientation, but also remains unremoved from the steel material and hence reduces iron loss benefit. Hence, each such element needs to be not more than about 30 ppm in content. To gain improved magnetic flux density, the total content of these elements is preferably not more than about 65 ppm.

Preferably, C is decreased to about 50 ppm or less to prevent the steel sheet product from becoming magnetically run out.

Ni can also be added to obtain improved magnetic flux density. Contents of less than about 0.01 wt % are ineffective for improving such magnetic flux density. Contents of more than about 1.50 wt % makes it insufficient to develop a structure of {110}<001> with eventual reduction in magnetic flux density. Hence, the content of Ni is preferably in the range of about 0.01 to 1.50 wt %.

Sn: about 0.01 to 0.50 wt %, Sb: about 0.005 to 0.50 wt %, Cu: about 0.01 to 0.50 wt %, Mo: about 0.005 to 0.50 wt % and Cr: about 0.01 to 0.50 wt % can preferably be added to improve iron loss. Contents of each such element of less than the lower limit are ineffective for improving iron loss, while contents of each such element of more than the upper limit fail to develop a structure of {110}<001>, affecting iron loss.

In making a novel steel sheet according to this invention, a steel slab is prepared, by an ingot making method or by continuous casting, from molten steel formulated with critically controlled components. Alternatively, a thin cast sheet with a thickness of not more than about 100 mm may be prepared by direct casting with critically controlled components according to this invention.

Such steel slab is usually heated and then subjected to hot rolling. The slab may be hot-rolled as it is with after-cast heating omitted. The thin cast sheet may be subjected to hot rolling or may be used as it is at a subsequent process stage with no need for hot rolling.

As a slab heating temperature, about 1,100° C. is sufficient that is the lowest possible temperature to effect hot rolling because no inhibitors are present in the starting steel material.

After hot rolling, hot-rolled sheet annealing is performed where desired, followed by cold rolling once, or twice or more, so that a cold-rolled sheet is finished to have a final thickness. Here, plural cold rolling includes intermediate annealing. The resultant cold-rolled sheet is recrystallized-annealed by means of continuous annealing and then provided optionally with an inorganic, semi-organic or organic coating, whereby a steel sheet product is provided.

Hot-rolled sheet annealing and intermediate annealing are useful for improving the magnetic flux density and for stabilizing the steel sheet product. However, these treatments are rather costly and should be strictly considered from economical points of view.

Hot-rolled sheet annealing and intermediate annealing need heating at temperatures ranging from about 800 to 1,050° C. At temperatures lower than 800° C., recrystallization does not proceed sufficiently. Temperatures higher than 1,050° C. hinder the development of {110}<001> oriented structure.

In the present invention, the average grain diameter before final cold rolling should be in the range of about 0.03 to 0.20 mm. Departures from this range fail to sufficiently develop a {110}<001> oriented structure after recrystallization annealing.

In order to control the average grain diameter before final cold rolling to be in the range of about 0.03 to 0.20 mm, the annealing temperatures and annealing times before final cold rolling can be controlled advantageously. The grain diameter after hot rolling may be controlled by varying the heating temperatures before hot rolling, finishing rolling temperatures and reduction ratios.

The reduction ratio should be in the range of about 55 to 75% during final cold rolling. Departures from this range bring about insufficient development of a {110}<001> oriented structure so that the magnetic flux density cannot be improved as desired.

Recrystallization annealing after final cold rolling by means of continuous annealing is performed at from about 950 to 1,175° C. At temperatures lower than about 950° C., {110}<001> oriented structure after recrystallization annealing is not sufficiently developed, and the magnetic flux density is reduced. At temperatures higher than about 1,175° C., the steel sheet product is mechanically weak, and running of the sheet is difficult to effect with creeping during annealing. Hence, recrystallization annealing is performed at from about 950 to 1,175° C. Annealing times are preferably in the range of about 30 to 300 seconds. Continuous annealing is advantageous as the grain diameter of the product sheet is arbitrarily variable, and at the same time, the resultant steel sheet product is free of a forsterite coating on the surface thereof and satisfactory in respect of punching.

After final cold rolling or after recrystallization annealing, the amount of Si on the surface of the resulting steel sheet may be increased by means of silicon implantation.

When being used as laminated one on another, the steel sheet products are preferably provided on their respective surfaces with an insulation coating. In this instance, the coating may be of a multi-layered construction having two or more layers. The coating may also contain a resin and the like according to the applications of the steel sheet product.

In the case where the thickness of the electromagnetic steel sheet is less than about 0.15 mm, the product is not only difficult to handle, but also less rigid and difficult to punch. To ensure superior formability, sheet thicknesses of more than about 0.15 mm are necessary.

In the case where the average grain diameter of the electromagnetic steel sheet is less than about 0.15 mm, the magnetic properties become deteriorated during stress relief annealing after forming, as is apparent from FIG. 7. In average grain diameters of more than about 2.0 mm, superior formability cannot be obtained, as seen in FIG. 6. Hence, the average grain diameter is in the range of about 0.15 to 2.0 mm.

When the electromagnetic steel sheet is used as a material for use in transformers or in electromagnetic shields, the magnetic flux density in the rolling direction is required to be $B_8$>about 1.70 T. $B_8$>about 1.75 T is further preferred from the viewpoint of working efficiency of electrical facilities used.

The following examples are provided to further illustrate the present invention. Also, this invention is not restricted to these examples.

EXAMPLE 1

Steel slabs were prepared by direct casting, which slabs were formulated with C: 30 wt ppm, Si: 3.20 wt %, Mn: 0.10 wt % and Al: 0.0034 wt % together with Se<5 ppm, S: 20 ppm, N: 6 ppm and O: 10 ppm, the balance being composed substantially of Fe. After being heated at 1,150° C. for 20 minutes, each such slab was hot-rolled to have a thickness of 2.0 mm. Upon hot-rolled sheet annealing at 1,000° C. for 60 seconds, cold rolling, intermediate annealing and further cold rolling were performed under the conditions shown in Table 1 so that the resultant steel sheet was made to have a final thickness of 0.35 mm. The average grain diameter before final cold rolling and after intermediate annealing was measured with the results tabulated also in Table 1.

Subsequent recrystallization annealing was performed in a hydrogen atmosphere and under the conditions shown in Table 1, and a coating solution was then applied, followed by baking at 300° C., whereby a steel sheet product was provided. The coating solution used here was prepared by mixing aluminum bichromate, emulsion resin and ethylene glycol. The resultant steel sheet product was inspected for the magnetic properties and formability with the results tabulated also in Table 1. The formability was judged by drilling at 100 points with a 5 mm-diameter drill and by checking wrinkling and cracking around the drilled holes.

From the results of Table 1, it has been found that when produced with an average grain diameter of 0.03 to 0.20 mm and a reduction ratio of 55 to 75%, the steel sheet product is provided with superior magnetic flux density by means of continuous annealing and also with superior formability.

TABLE 1

| | Intermediate annealing conditions | | | | | | | | | |
|---|---|---|---|---|---|---|---|---|---|---|
| | Intermediate sheet thickness (mm) | Uniform heating temperature (° C.) | Time (sec) | Average crystal grain diameter before final cold rolling (mm) | Reduction ratio at final cold rolling (%) | Recrystallization annealing temperature: Uniform heating 3 min (° C.) | Magnetic flux density $B_8$ (T) | Iron loss $W_{17/50}$ (W/kg) | Formability Frequency of cracking and wrinkling (%) | Remarks |
| 1 | 0.90 | 900 | 60 | 0.092 | 67.8 | 1050 | 1.82 | 1.25 | 0 | Present Invention |
| 2 | 0.90 | 1000 | 60 | 0.133 | 67.8 | 1050 | 1.82 | 1.25 | 0 | Present Invention |
| 3 | 0.90 | 1050 | 60 | 0.188 | 67.8 | 1100 | 1.81 | 1.25 | 0 | Present Invention |
| 4 | 0.80 | 900 | 60 | 0.088 | 63.8 | 1120 | 1.80 | 1.25 | 0 | Present Invention |
| 5 | 0.70 | 900 | 60 | 0.065 | 58.6 | 1000 | 1.80 | 1.25 | 0 | Present Invention |
| 6 | 1.00 | 900 | 60 | 0.122 | 71.0 | 1020 | 1.80 | 1.25 | 0 | Present Invention |
| 7 | 0.90 | 700 | 60 | 0.025 | 67.8 | 1050 | 1.70 | 1.66 | 0 | Comparative Example |
| 8 | 0.90 | 1150 | 60 | 0.420 | 67.8 | 1050 | 1.66 | 1.96 | 0 | Comparative Example |
| 9 | 0.50 | 900 | 60 | 0.055 | 42.0 | 1050 | 1.73 | 1.56 | 0 | Comparative Example |
| 10 | 1.20 | 900 | 60 | 0.183 | 75.8 | 1050 | 1.71 | 1.77 | 0 | Comparative Example |
| 11 | 0.90 | 900 | 60 | 0.093 | 67.8 | 850 | 1.74 | 1.75 | 0 | Comparative Example |
| 12 | 0.90 | 1000 | 60 | 0.130 | 67.8 | 850° C. × 50 hr | 1.81 | 1.30 | 5 | Comparative Example |

EXAMPLE 2

Steel slabs were formulated as shown in Table 2 and prepared by continuous casting. Each such slab was made to a steel sheet with a thickness of 4.0 mm by being immediately hot-rolled without slab reheating. After being heated at 1,170° C. for 20 minutes, the steel sheet was hot-rolled to a thickness of 2.6 mm, followed by hot-rolled sheet annealing at 900° C. for 30 seconds, so that the hot-rolled sheet was finished by cold rolling to an intermediate thickness of 0.60 mm. Then, intermediate annealing was performed at 850° C. for 30 seconds, followed by cold rolling, whereby a cold-rolled sheet was obtained with a final thickness of 0.23 mm. Subsequent recrystallization annealing was performed at 1,000° C. for 180 seconds, and a coating solution was applied which had been prepared by mixing aluminum phosphate, potassium bicarbonate and boric acid. Baking at 300° C. provided a steel sheet product.

The resultant steel sheet product was inspected for the magnetic properties and formability with the results tabulated also in Table 2.

From the results of Table 2, it has been found that when each of Se, S, N and O is set to be not more than about 30 ppm, a steel sheet product is provided with a magnetic flux of $B_8$>about 1.75 T.

TABLE 2

| | Molten steel components (wt %) (O, N, Al, Se and S; wt ppm) | | | | | | | | | | | | | | Average crystal grain diameter before final cold rolling | Magnetic flux density $B_8$ | Iron lose $W_{17/50}$ | |
|---|---|---|---|---|---|---|---|---|---|---|---|---|---|---|---|---|---|---|
| | C | Si | Mn | Ni | Sn | Sb | Cu | Mo | Cr | O | N | Al | Se | S | (mm) | (T) | (W/kg) | Remarks |
| 1 | 20 | 3.31 | 0.12 | 0.40 | tr | tr | tr | tr | tr | 11 | 9 | 40 | tr | 19 | 0.122 | 1.86 | 0.89 | Present Invention |
| 2 | 30 | 3.52 | 0.15 | 0.23 | tr | tr | tr | tr | tr | 15 | 15 | 33 | tr | 9 | 0.155 | 1.84 | 0.89 | Present Invention |
| 3 | 30 | 3.27 | 0.25 | tr | tr | tr | tr | tr | tr | 12 | 13 | 21 | tr | 15 | 0.131 | 1.83 | 0.92 | Present Invention |
| 4 | 30 | 3.42 | 0.15 | tr | 0.11 | tr | tr | tr | tr | 12 | 12 | 56 | tr | 12 | 0.082 | 1.83 | 0.89 | Present Invention |
| 5 | 30 | 3.17 | 0.20 | tr | tr | 0.03 | tr | tr | tr | 11 | 11 | 31 | tr | 10 | 0.090 | 1.83 | 0.89 | Present Invention |

TABLE 2-continued

| | Molten steel components (wt %) (O, N, Al, Se and S: wt ppm) | | | | | | | | | | | | | | Average crystal grain diameter before final cold rolling | Magnetic flux density $B_8$ | Iron lose $W_{17/50}$ | |
|---|---|---|---|---|---|---|---|---|---|---|---|---|---|---|---|---|---|---|
| | C | Si | Mn | Ni | Sn | Sb | Cu | Mo | Cr | O | N | Al | Se | S | (mm) | (T) | (W/kg) | Remarks |
| 6 | 20 | 3.22 | 0.22 | tr | tr | tr | 0.20 | tr | tr | 19 | 8 | 39 | tr | 19 | 0.098 | 1.83 | 0.90 | Present Invention |
| 7 | 30 | 3.59 | 0.35 | tr | tr | tr | tr | 0.03 | tr | 10 | 10 | 21 | tr | 11 | 0.111 | 1.82 | 0.88 | Present Invention |
| 8 | 30 | 3.33 | 0.05 | tr | tr | tr | tr | tr | 0.31 | 9 | 11 | 61 | tr | 15 | 0.120 | 1.83 | 0.90 | Present Invention |
| 9 | 10 | 3.39 | 0.91 | tr | tr | tr | tr | tr | tr | 69 | 20 | 54 | tr | 13 | 0.085 | 1.65 | 1.65 | Comparative Example |
| 10 | 20 | 3.23 | 0.30 | tr | tr | tr | tr | tr | tr | 19 | 70 | 45 | tr | 12 | 0.088 | 1.69 | 1.51 | Comparative Example |
| 11 | 30 | 3.33 | 0.90 | tr | tr | tr | tr | tr | tr | 19 | 20 | 154 | tr | 16 | 0.079 | 1.66 | 1.59 | Comparative Example |
| 12 | 20 | 3.36 | 0.13 | tr | tr | tr | tr | tr | tr | 10 | 19 | 24 | 80 | 11 | 0.077 | 1.61 | 1.85 | Comparative Example |
| 13 | 30 | 3.30 | 0.10 | tr | tr | tr | tr | tr | tr | 15 | 14 | 21 | tr | 71 | 0.102 | 1.73 | 1.65 | Comparative Example |

EXAMPLE 3

Thin cast steel sheets of 4.5 mm in thickness were prepared by direct casting, which cast sheets were formulated with C: 20 ppm, Si: 3.25 wt %, Mn: 0.14 wt % and Al: 0.005 wt % together with Se<5 ppm, S: 10 ppm, N: 10 ppm and O: 15 ppm, the balance being composed substantially of Fe. Hot-rolled sheet annealing was performed under the conditions shown in Table 3, and after measurement of the average grain diameter, the resultant steel sheet was finished by cold rolling to a final thickness of 1.2 mm. The reduction ratio during final cold rolling was 73.3%. Subsequent recrystallization annealing was performed in an Ar atmosphere at 1,000° C. for 5 minutes, whereby a steel sheet product was provided. The resultant steel sheet product was examined with the results tabulated also in Table 3.

From the results of Table 3, it has been found that when the average grain diameter before final cold rolling is in the range of about 0.03 to 0.20 mm, a steel sheet product is obtainable with high permeability by means of continuous annealing.

TABLE 3

| | Uniform heating temperature (°C.) | Time (sec) | Average crystal grain diameter before final cold rolling (mm) | Magnetic flux density $B_8$ (T) | Maximum permeability ($\mu/\mu_o$) | Remarks |
|---|---|---|---|---|---|---|
| 1 | 1000 | 100 | 0.122 | 1.78 | 35800 | Present Invention |
| 2 | 1050 | 100 | 0.167 | 1.79 | 38100 | Present Invention |
| 3 | 1100 | 20 | 0.185 | 1.80 | 40200 | Present Invention |
| 4 | 1200 | 30 | 0.380 | 1.65 | 20300 | Comparative Example |

TABLE 3-continued

| | Uniform heating temperature (°C.) | Time (sec) | Average crystal grain diameter before final cold rolling (mm) | Magnetic flux density $B_8$ (T) | Maximum permeability ($\mu/\mu_o$) | Remarks |
|---|---|---|---|---|---|---|
| 5 | 700 | 10 | 0.025 | 1.70 | 22200 | Comparative Example |

EXAMPLE 4

Steel slabs were prepared by direct casting, which slab were formulated with C: 30 ppm, Si: 3.20 wt %, Mn: 0.05 wt % and Al: 0.0030 wt % and with the balance composed substantially of Fe. After being heated at 1,000° C. for 60 seconds, each such slab was hot-rolled to a steel sheet with a thickness of 2.0 mm. Upon hot-rolled sheet annealing 1,000° C. for 60 seconds, the resultant steel sheet was cold-rolled to have an intermediate thickness of 0.90 mm, followed by intermediate annealing at 850° C. for 60 seconds and by subsequent second cold rolling of the intermediate-annealed steel sheet to have a final thickness of 0.35 mm (reduction ratio during final rolling: 61.1%).

Subsequent recrystallization annealing was performed in a hydrogen atmosphere and under the conditions shown in Table 4, and a coating solution was then applied, followed by baking at 300°C., whereby a steel sheet product was provided. The coating solution used was prepared by mixing aluminum bichromate, emulsion resin and ethylene glycol.

The resultant steel sheet product was inspected for the average grain diameter, magnetic flux density, iron loss and formability with the results tabulated also in Table 4.

The formability was judged by drilling at 100 points with a 5 mm-diameter drill and by checking cracking and wrinkling around the drilled holes.

From the results of Table 4, it has been found that when the average grain diameter is in the range of 0.15 to 2.0 mm, superior formability is attainable along with superior magnetic flux density sufficiently enough to satisfy $B_8$>1.70 T.

TABLE 4

| No. | Recrystallization annealing conditions: Uniform heating temperature (° C.) | Time (sec) | Average crystal grain diameter (mm) | Magnetic flux density $B_8$ (T) | Iron loss $W_{17/50}$ (W/kg) | Frequency of cracking and wrinkling (%) | Remarks |
|---|---|---|---|---|---|---|---|
| 1 | 900 | 120 | 0.22 | 1.80 | 1.45 | 0 | Acceptable Example |
| 2 | 1000 | 180 | 0.68 | 1.81 | 1.39 | 0 | Acceptable Example |
| 3 | 1050 | 180 | 1.02 | 1.82 | 1.34 | 0 | Acceptable Example |
| 4 | 1100 | 300 | 1.58 | 1.83 | 1.35 | 0 | Acceptable Example |
| 5 | 1120 | 300 | 1.82 | 1.83 | 1.33 | 2 | Acceptable Example |
| 6 | 1150 | 400 | 2.18 | 1.82 | 1.33 | 25 | Comparative Example |
| 7 | 900 | 10 | 0.10 | 1.68 | 1.67 | 0 | Comparative Example |

EXAMPLE 5

Steel slabs composed as shown in Table 5 were prepared by direct casting and then hot-rolled as they were without after-cast heating so that hot-rolled steel sheets were formed with a thickness of 2.0 mm. Upon hot-rolled sheet annealing at 900° C. for 30 seconds, each such steel sheet was cold-rolled to have an intermediate thickness of 0.60 mm. After being subjected to intermediate annealing, the cold-rolled was finished with a final thickness of 0.20 mm by means of second cold rolling (reduction ratio during final cold rolling: 66.6%).

Subsequent recrystallization annealing was performed in a nitrogen atmosphere and at 1,000° C. for 180 seconds, and, coating solution was then applied which had been prepared by mixing aluminum phosphate, potassium bichromate and boric acid. Baking at 300° C. gave a steel sheet product.

The steel sheet product thus provided was inspected for the average grain diameter, magnetic flux density, iron loss and formability with the results tabulated also in Table 5.

The formability was judged in the same manner as in Example 4.

From the results of Table 5, it has been found-that when each of Se, S, N and O is decreased to about 30 ppm in content, a steel sheet product is obtained with an average grain diameter of about 0.15 to 2.0 mm and with superior formability and magnetic properties.

TABLE 5

| No. | Molten steel components (wt %) (O, N, Al, Se and S; ppm): C | Si | Mn | Ni | O | N | Al | Se | S | Average crystal grain diameter (mm) | Magnetic flux, density $B_8$ (T) | Iron loss $W_{17/50}$ (W/kg) | Frequency of cracking and wrinkling (%) | Remarks |
|---|---|---|---|---|---|---|---|---|---|---|---|---|---|---|
| 1 | 20 | 3.31 | 0.12 | 0.40 | 13 | 9 | 40 | tr | 19 | 1.35 | 1.85 | 0.91 | 0 | Acceptable Example |
| 2 | 30 | 3.57 | 0.15 | 0.23 | 15 | 19 | 33 | tr | 9 | 1.44 | 1.84 | 0.92 | 0 | Acceptable Example |
| 3 | 30 | 3.47 | 0.25 | tr | 9 | 11 | 14 | tr | 11 | 1.55 | 1.83 | 0.93 | 1 | Acceptable Example |
| 4 | 30 | 3.31 | 0.92 | tr | 19 | 20 | 143 | tr | 16 | 1.05 | 1.66 | 1.59 | 0 | Comparative Example |
| 5 | 20 | 3.23 | 0.13 | tr | 83 | 15 | 20 | tr | 11 | 1.15 | 1.68 | 1.49 | 1 | Comparative Example |
| 6 | 20 | 3.36 | 0.13 | tr | 10 | 59 | 44 | tr | 11 | 0.92 | 1.61 | 1.83 | 22 | Comparative Example |
| 7 | 30 | 3.30 | 0.10 | tr | 15 | 14 | 21 | 90 | 21 | 0.11 | 1.60 | 1.64 | 20 | Comparative Example |

TABLE 5-continued

| No. | Molten steel components (wt %) (O, N, Al, Se and S; ppm) C | Si | Mn | Ni | O | N | Al | Se | S | Average crystal grain diameter (mm) | Magnetic flux, density $B_8$ (T) | Iron loss $W_{17/50}$ (W/kg) | Frequency of cracking and wrinkling (%) | Remarks |
|---|---|---|---|---|---|---|---|---|---|---|---|---|---|---|
| 8 | 30 | 3.33 | 0.11 | tr | 18 | 10 | 31 | tr | 120 | 1.04 | 1.61 | 1.69 | 33 | Comparative Example |

EXAMPLE 6

Thin cast sheets of 8 mm in thickness were prepared which had been formulated with C: 30 wtppm, Si: 3.20 wt %, Mn: 0.07 wt % and Al: 0.0050 wt % and with the balance composed substantially of Fe. Each such cast sheet was hot-rolled as it was without after-cast heating so that the hot-rolled steel sheet was made to have a thickness of 2.0 mm. Upon hot-rolled sheet annealing at 1,000° C. for 60 seconds, the resultant steel sheet was cold-rolled to have a final thickness of 0.90 mm (reduction ratio during final cold rolling: 55.0%). Subsequently, recrystallization annealing was performed in an Ar atmosphere and under the conditions shown in Table 6, whereby a steel sheet product was provided.

The steel sheet product thus obtained was inspected for the average grain diameter, magnetic flux density, iron loss and formability with the results tabulated also in Table 6.

From the results of Table 6, it was found that superior formability and magnetic properties were attained when the requirements of the present invention were satisfied.

TABLE 6

| No. | Recrystallization annealing conditions: Uniform heating temperature (° C.) | Time (sec) | Average crystal grain diameter (mm) | Magnetic flux density $B_9$ (T) | Maximum permeability $\mu/\mu_0$ | Frequency of cracking and wrinkling (%) | Remarks |
|---|---|---|---|---|---|---|---|
| 1 | 1000 | 80 | 0.32 | 1.78 | 35800 | 0 | Acceptable Example |
| 2 | 1050 | 150 | 0.78 | 1.79 | 38100 | 0 | Acceptable Example |
| 3 | 1100 | 180 | 1.38 | 1.80 | 40200 | 0 | Acceptable Example |
| 4 | 1150 | 500 | 2.38 | 1.80 | 40900 | 28 | Comparative Example |
| 5 | 900 | 10 | 0.12 | 1.68 | 22500 | 0 | Comparative Example |

According to the present invention, a {110}<001> oriented structure was effectively developed by cold-rolling the inhibitor-free high-purity starting steel material under the specified conditions, followed by recrystallization annealing by means of continuous annealing. Thus, an electromagnetic steel sheet was obtainable with an average grain diameter of about 0.15 to 2.0 mm and with superior formability and magnetic properties.

What is claimed is:

1. A rolled electromagnetic steel sheet having superior formability and magnetic properties, which sheet has a {110}<001> orientation, which sheet comprises Si in a content of about 2.0 to 8.0 wt %, a thickness of about 0.15 mm or more, an average grain diameter of about 0.15 to 2.0 mm and a magnetic flux density of $B_8$>about 1.70 T in the direction of said rolling, which sheet further comprises Mn in a content of about 0.005 to 3.0 wt % and Al in a content of about 0.0010 to 0.012 wt %, with each of Se, S, N and O at a content of not more than about 30 ppm.

2. The electromagnetic steel sheet according to claim 1, wherein the total content of Se, S, N and O is not more than about 65 ppm, and the magnetic flux density is $B_8$>about 1.75 T in the direction of said rolling.

3. The electromagnetic steel sheet according to claim 1, which further comprises Ni in a content of about 0.01 to 1.50 wt %.

4. The electromagnetic steel sheet according to claim 1, which further comprises at least one element selected from the group consisting of Sn in a content of about 0.01 to 0.50 wt %, Sb in a content of about 0.005 to 0.50 wt %, Cu in a content of about 0.01 to 0.50 wt %, Mo in a content of about 0.005 to 0.50 wt % and Cr in a content of about 0.01 to 0.50 wt %.

* * * * *

UNITED STATES PATENT AND TRADEMARK OFFICE

CERTIFICATE OF CORRECTION

PATENT NO. : 6,432,227 B1
DATED : August 13, 2002
INVENTOR(S) : Yasuyuki et al.

It is certified that error appears in the above-identified patent and that said Letters Patent is hereby corrected as shown below:

Column 4,
Line 17, please delete “5” after “to”.

Column 10,
Line 31, please change “3” to -- S --.

Signed and Sealed this

Eighteenth Day of March, 2003

JAMES E. ROGAN
*Director of the United States Patent and Trademark Office*